United States Patent [19]

Dosch

[11] Patent Number: 4,757,990

[45] Date of Patent: Jul. 19, 1988

[54] MARTIAL ARTS APPARATUS FOR HOLDING PAPER TAUT

[76] Inventor: Daniel R. Dosch, Box 57, Surrey, N. Dak. 58785

[21] Appl. No.: 901,404

[22] Filed: Aug. 28, 1986

[51] Int. Cl.[4] ..... A63B 69/00

[52] U.S. Cl. ..... 272/76; 272/62; 272/900; 248/231.2

[58] Field of Search ..... 272/76–78, 272/900, 63, 62; 273/407; 40/603, 604; 248/231.4, 231.2, 421; 108/61

[56] References Cited

U.S. PATENT DOCUMENTS

| | | | |
|---|---|---|---|
| 489,750 | 1/1893 | Medart | 272/78 |
| 802,312 | 10/1905 | Pierro | 272/62 |
| 2,890,051 | 6/1959 | Williams | 273/407 |
| 3,601,353 | 8/1971 | Dale | 273/407 |
| 4,050,693 | 9/1977 | Lichterman | 272/62 |
| 4,293,127 | 10/1981 | Dudley | 272/900 |

*Primary Examiner*—Richard J. Apley
*Assistant Examiner*—S. R. Crow
*Attorney, Agent, or Firm*—Zarley, McKee, Thomte, Voorhees & Sease

[57] ABSTRACT

A martial arts paper holding apparatus includes a pair of horizontal support members adjustably mounted between the vertical sides of a door frame. Threaded bolts with rotatable, enlarged flat heads are mounted in the ends of the horizontal support members and may be adjusted inwardly and outwardly. A pair of vertical support members are adjustably mounted through slots in the horizontal support members. Layers of newspaper or the like are stretched between the two vertical support members and held in place by clamps. Wing nuts threaded on the ends of the vertical support members are tightened against the horizontal support members to fasten the vertical members in selected positions.

4 Claims, 2 Drawing Sheets

MARTIAL ARTS APPARATUS FOR HOLDING PAPER TAUT

TECHNICAL FIELD

This invention relates generally to devices for holding paper and the like taut for use in kicking excercises. More specifically, this invention is an improved device which is capable of removable and adjustable mounting in a door frame.

BACKGROUND OF THE INVENTION

In demonstrations of the martial arts, it is typical to see the feet and hands used to break boards and the like which are being held by another person. However, before it is possible to break boards, it is typical to begin by practicing using layers of newspaper or the like held taut by an assistant. As the person's skill and strength increase, the number of layers of paper are increased.

Presently, such practice requires that an assistant hold the paper stretched between his hands. Thus, it is necessary to have a second person in order to practice these maneuvers. Even with an assistant available, the job of holding the paper for a novice "kicker" can be potentially hazardous.

It is therefore an object of the present invention to provide an improved apparatus for holding paper or the like taut.

Another object is to provide a paper holding apparatus which does not require a person to hold the device at the desired height.

Yet another object of the present invention is to provide a paper holding apparatus which is easily adjusted to various sizes of paper.

Still another object is to provide a paper holding apparatus which may be adjusted to various heights.

A further object of the invention is to provide a paper holding apparatus which is economical to manufacture, durable in use and refined in appearance.

These and other objects will be apparent to one skilled in the art.

SUMMARY OF THE INVENTION

The paper holding apparatus of this invention includes a pair of horizontal support members adjustably mounted between the vertical sides of a door frame. Threaded bolts with rotatable enlarged flat heads are mounted in the ends of the horizontal support members and may be adjusted inwardly and outwardly by rotation of th bolt shank. A pair of vertical support members comprised of threaded rods are adjustablay mounted through slots in the horizontal support members using wing nuts and washers for clamping onto the horizontal supports. Layers of newspaper or the like are stretched between the two rods and held in place by clamps. The vertical rods are adjusted outwardly and fastened in place in order to hold the paper in a tightly stretched orientation.

DESCRIPTION OF THE PREFERRED EMBODIMENT

Figure 1:
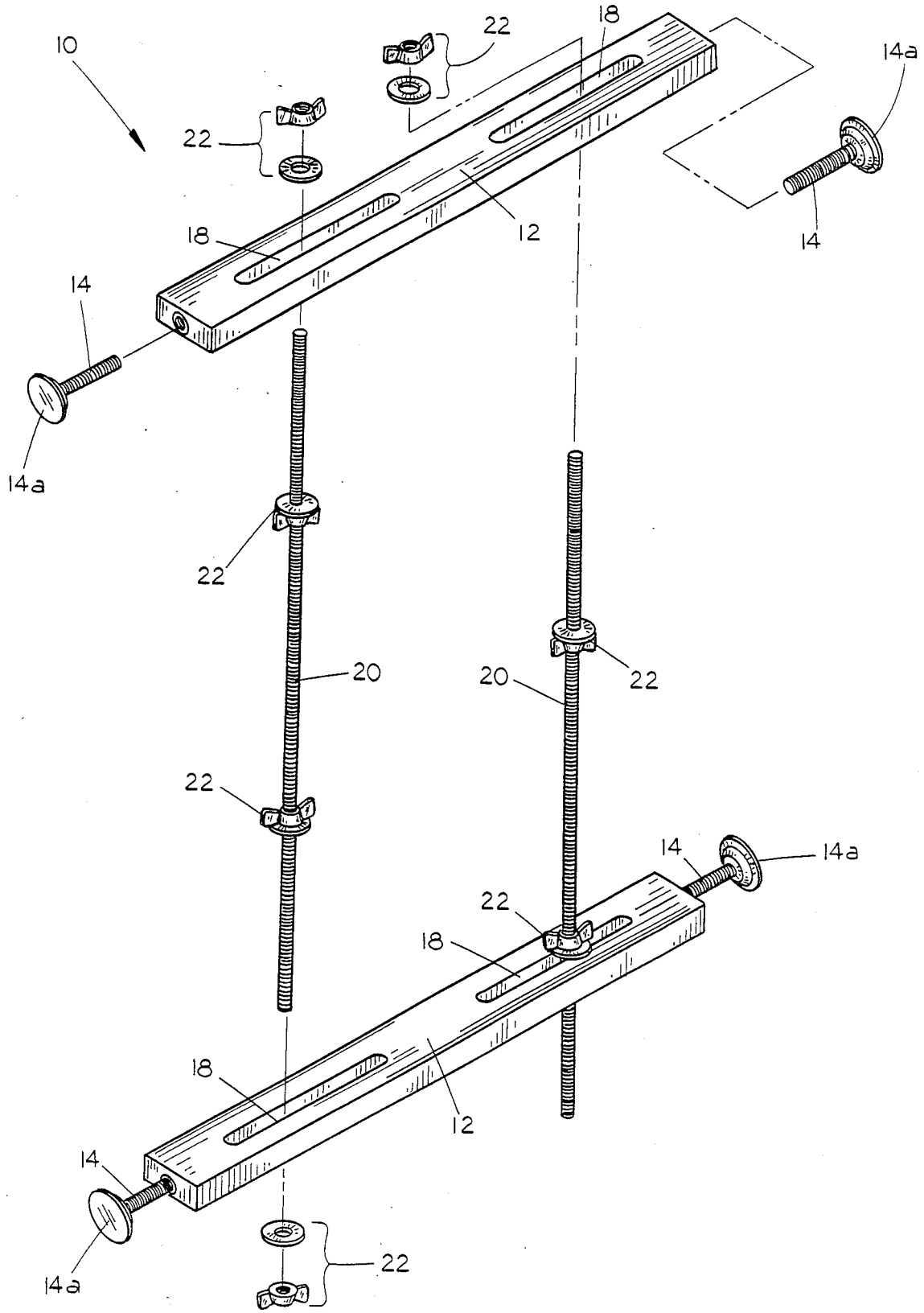
FIG. 1 is an enlarged exploded perspective view of the invention.
Figure 2:
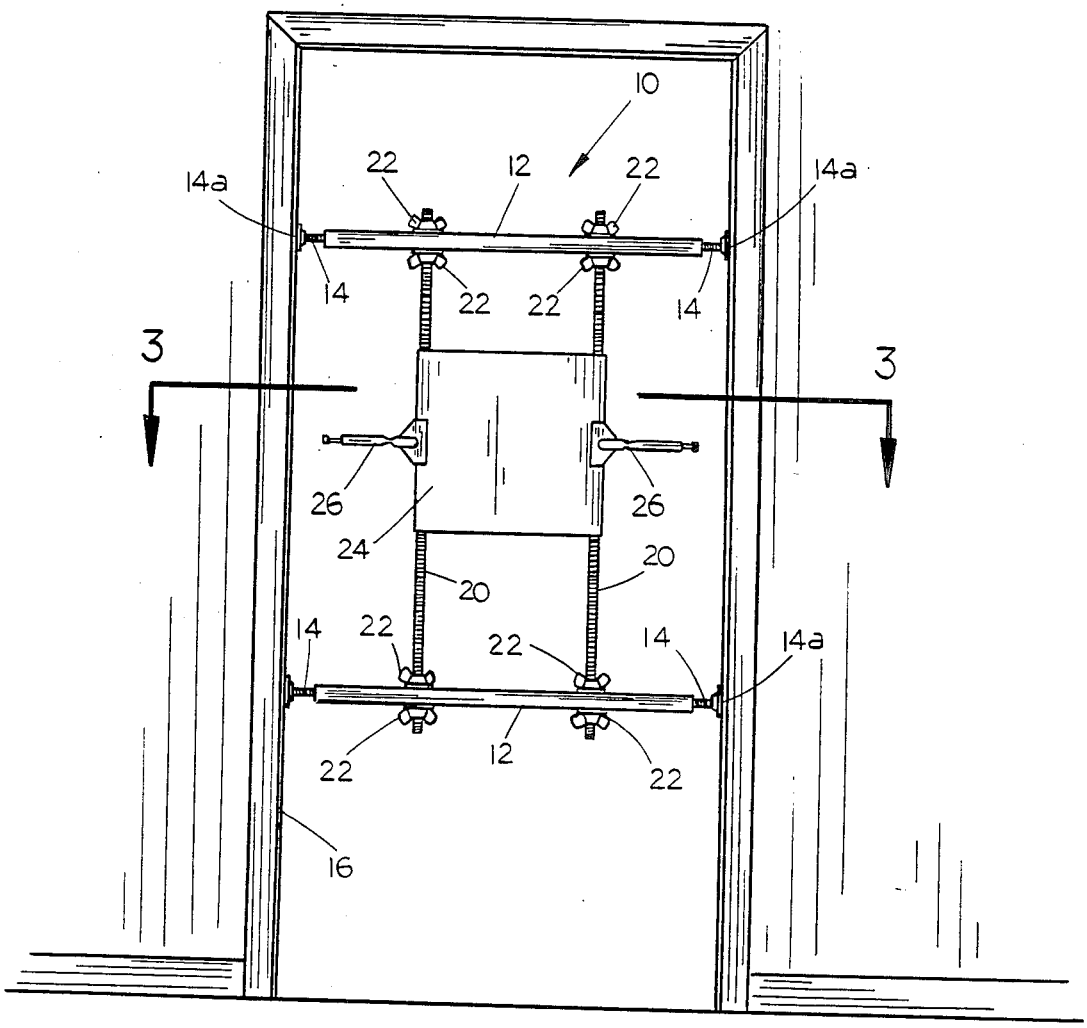
FIG. 2 is a front elevational view of the invention mounted within a door frame.
Figure 3:
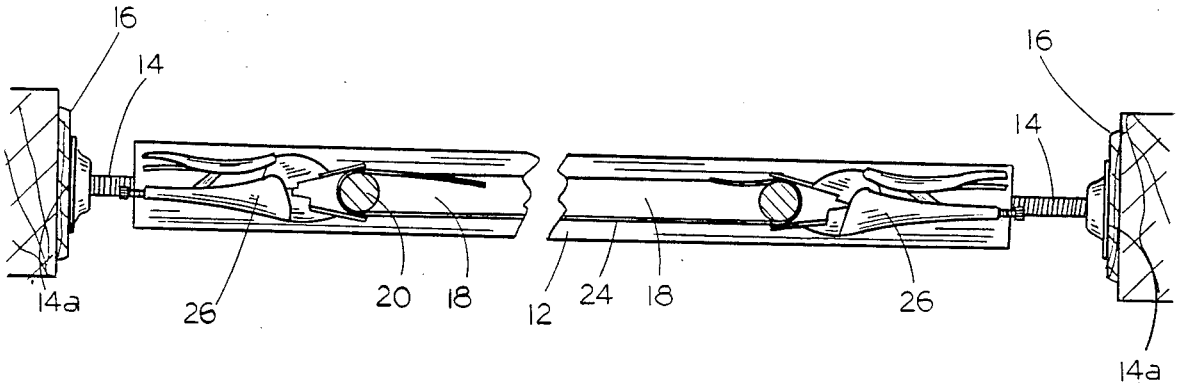
FIG. 3 is a sectional view taken at lines 3—3 in FIG. 2.

Referring now to the drawings, in which similar or corresponding parts have the same reference character throughout the several views, the paper holding apparatus of this invention is indicated generally at 10.

Paper holding apparatus 10 includes a pair of rigid horizontal support members 12 having threaded bolts 14 mounted in each end. Each bolt 14 has an enlarged flattened head portion 14*a* rotatably mounted in its projecting ends which may be tightened against the vertical members of a doorway frame 16, by rotating the shanks of bolts 14.

Horizontal support members 12 are spaced-apart vertically and have a pair of longitudinal slots 18 aligned along the longitudinal axis of each member 12. Slots 18 will be vertically oriented when paper holding apparatus 10 is mounted within door frame 16, and will be vertically aligned with the slots 18 in the other horizontal support member 12.

An elongated rod 20 extends vertically between horizontal support members 12 and projects through the vertically aligned slots 18. A wing nut and washer combination 22, holds each rod 20 in its selected location within slots 18, as shown in the drawings. Newspaper 24 may then be clamped to rods 20 using a pair of clamps 26. Newspaper 24 may also be held in place by wrapping an edge around each rod 20 and rotating the rods 20 to further wrap the paper 24 upon itself. In this way, no clamps would be necessary to keep the paper 24 stretched taut.

In operation, paper holding apparatus 10 may be fastened in various widths of doorways simply by rotating bolts 14 inwardly or outwardly. Head portions 14*a* allow the device to be mounted within a doorway without damaging the woodwork, yet furnishing a strong support for paper 24. Once horizontal members 12 are fastened, rods 20 are inserted through slots 18 and loosely fastened in position via wing nuts 22.

Newspapers, paper bags or the like, of the selected number of layers are then wrapped around each rod 20 and clamped in place. Clamps 26 may be of any of the various types conventionally available, such as locking pliers or battery jumper cable type clamps. The inventor has found that a greater number of layers of paper typically requires the stronger gripping power of locking pliers or the like.

Once paper 24 is clamped in position, it can be tightened to the desired tension by fastening one rod 20 in position with wing nuts 22, and then sliding the other rod 20 within slots 18. After both rods 20 are fastened in position, the stretched paper is ready for use as a target for one wishing to practice his kicking skills.

Paper 24 may be easily replaced by merely clamping a new piece of paper in place and adjusting one of rods 20 to stretch the paper taut. As the user gains strength and ability, the number of sheets of paper 24 may be increased to practice stronger kicks. The adjustability of the support members allows the paper to be positioned at many different heights as required by the user. The "target area" between the two pairs of support members may be increased or decreased simply by adjusting the positioning of the horizontal and vertical support members.

It can therefore be seen the present invention accomplishes at least all of the above stated objectives.

What is claimed is:

1.

A martial arts paper holding apparatus comprising:

upper and lower generally horizontal support members, each having means for adjustably, removably mounting said members between the vertical sides of a door frame, said upper horizontal support member having a pair of vertically oriented longitudinal slots therein;

said lower horizontal support member having a pair of vertically oriented longitudinal slots therein aligned with the slots in said upper member;

a pair of spaced-apart generally vertical support members having means for adjustably mounting said vertical support members between said upper and lower horizontal support members, said vertical support members being rods, one rod extending through one slot in the upper horizontal support member and the corresponding slot in the lower horizontal support member, and the other rod extending through the other slot and the upper horizontal support member and the corresponding slot int he lower horizontal support member, and means for holding a layer of paper stretched taut between said vertical support members.

2. The paper holding apparatus of claim 1 wherein the means for adjustably, removably mounting the horizontal support members to the door frame includes a threaded bolt operably mounted in each end of each support member, said bolts projecting therefrom, each bolt having a head portion on the projecting end thereof, whereby said bolts may be inwardly and outwardly adjusted by rotating said bolt.

3. The paper holding apparatus of claim 1 wherein said rods are threaded at each end and are adjustably fastened to said horizontal support members with a pair of threaded nuts operably mounted in each end of said rod, one nut tightened against each side of each said horizontal support member when the rod is positioned in the desired location.

4. The paper holding apparatus of claim 1 further comprising clamping means removably clamped to each vertical support member for holding at least one layer of paper.

* * * * *